US005950920A

United States Patent [19]

Acosta

[11] Patent Number: 5,950,920

[45] Date of Patent: Sep. 14, 1999

[54] COMPACTOR ASSEMBLY FOR USE WITH RECYCLING BINS

[75] Inventor: Evelio Acosta, Miami, Fla.

[73] Assignee: Atlantic Maintenance of Miami, Miami, Fla.

[21] Appl. No.: 08/854,281

[22] Filed: May 9, 1997

[51] Int. Cl.[6] ..... B65D 91/00

[52] U.S. Cl. ..... 232/43.1; 232/44

[58] Field of Search ..... 232/44, 43.1, 43.2, 232/43.3, 43.5; 193/31 A, 31 R

[56] References Cited

U.S. PATENT DOCUMENTS

| | | | |
|---|---|---|---|
| 1,538,239 | 5/1925 | Claudepierre | 193/31 A |
| 3,861,296 | 1/1975 | Clar | 232/43.2 X |
| 3,863,561 | 2/1975 | Karls | 232/43.1 X |
| 4,373,435 | 2/1983 | Grevich . | |
| 4,987,988 | 1/1991 | Messina et al. | 232/43.2 X |
| 5,031,829 | 7/1991 | Shantzis | 232/43.2 |
| 5,213,402 | 5/1993 | Bernal et al. | 232/43.1 X |
| 5,221,010 | 6/1993 | Bianco | 232/43.2 X |
| 5,257,577 | 11/1993 | Clark | 232/43.2 X |
| 5,425,458 | 6/1995 | Gilcreest et al. | 232/43.2 X |
| 5,667,136 | 9/1997 | Chen | 232/43.2 |

*Primary Examiner*—Joanne Silbermann
*Assistant Examiner*—William L. Miller
*Attorney, Agent, or Firm*—Jon Carl Gealow

[57] ABSTRACT

An apparatus for receiving and separately storing recyclable waste materials of various types and non-recyclable waste materials. Recyclable or non-recyclable waste material is deposited in the open top of a receiving chamber. Deflectors when in a first position form a part of the sidewalls of the receiving chamber such that non-recyclable waste material deposited in the open top of the receiving chamber falls through an open bottom of the chamber into a compactor. Either of the deflectors in a second position closes the open bottom of the receiving chamber and deflects recyclable waste deposited in the open top of the receiving chamber into a storage container associated with the deflector in the second position.

11 Claims, 2 Drawing Sheets

COMPACTOR ASSEMBLY FOR USE WITH RECYCLING BINS

FIELD OF THE INVENTION

The present invention relates to a compactor assembly for use with recycling bins. More particularly it relates to a compactor assembly into which may be dumped the contents of collection containers each of which contains a particular type or types of recyclable material, or waste to be compacted. The assembly being controllable to direct the material to the proper recycling bin or to the compactor.

BACKGROUND OF THE INVENTION

It is no longer considered acceptable to mix together and collect all waste material for disposal in a landfill or incinerator. Rather, it has been found desirable, and is frequently mandated by laws that waste material be separate, such that recyclable material can be recycled. Thus, separate containers are provided in commercial establishments and even in residences for disposing of various types of recyclable materials. A separate container being provided for non-recyclable material, i.e. garbage. Relatively small containers are usually provided at the location where the wastes, either recyclable or not are created.

Particularly in commercial establishments, larger containers, readily movable by an individual, will be moved through the various areas of the establishment to collect the materials in the smaller containers. These larger containers are then moved to a collection area, where they can be emptied into still larger containers for removal of the recyclable material and compacted non-recyclable material from the establishment. While the larger containers are normal provided with wheels or casters, such that they may be readily pushed or pulled, when fulling loaded, they are quite heavy, such that it is not desirable to lift them in order to empty them. Thus, it is desirable to be able to empty them by merely tipping them over.

Rather than having different locations for dumping the large containers containing different recyclable materials, or non-recyclable waste into the still larger containers, it has in some cases been found desirable to be have only a single opening into which all of the large containers may be dumped. Various factors may make such an arrangement desirable. Some such factors are available space, safety considerations, and location of the collection point within a building.

Accordingly, it would be advantageous to provide an apparatus for selectively directing different types of recyclable material or non-recyclable material deposited in the same receptacle to bins or a compactor respectively.

SUMMARY OF THE INVENTION

It is an object of this invention to provide an apparatus for selectively directing different types of recyclable material or non-recyclable material deposited in the same receptacle or chute to a selected bin or a compactor respectively. It is a further object of this invention to provide such an apparatus in a compact arrangement which may be readily installed in a desired location. It is still another object of this invention to provide such an apparatus into which recyclable and non-recyclable material may be readily placed, and which may be readily controlled to deposit the material into the desired recyclable material container or a compactor.

In accordance with this invention, an apparatus for selectively directing different types of recyclable material or non-recyclable material deposited in the same receptacle to a selected bin or a compactor respectively is provided. The apparatus includes a receiving chamber having sidewalls, an open top and an open bottom. Movable deflectors when in a first position form at least a portion of the sidewalls. When the movable deflectors art in the first position, non-recyclable waste materials deposited through the open top of the receiving chamber pass through the open bottom into a compactor. Each of the movable deflectors may be moved to a second position such that they close the bottom of the receiving chamber and deflect recyclable waste material into a storage container. Only one of the movable deflectors may be in the second position, such that recyclable waste material is directed to either of two storage containers. Chute are provided on the sidewalls for directing the recyclable waste material into the storage containers.

DETAILED DESCRIPTION OF THE PREFERRED EMBODIMENT

Figure 1:
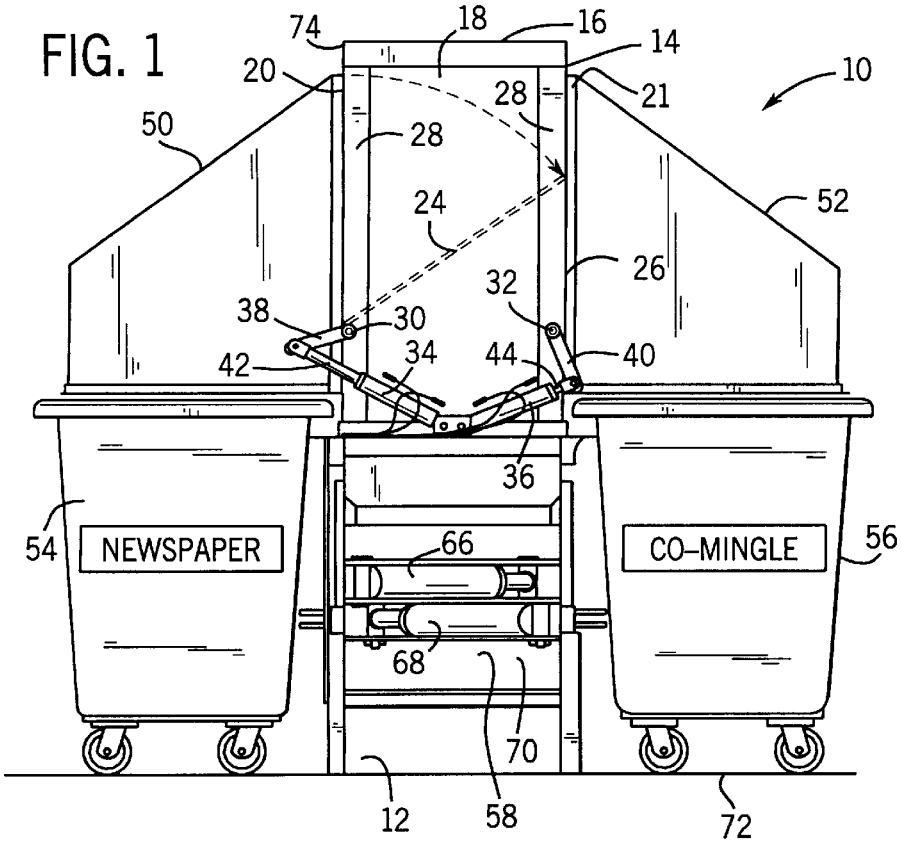
FIG. 1 is an end view, of an apparatus in accordance with this invention for selectively directing different types of recyclable material or non-recyclable material deposited in the same receptacle to an appropriate bin or a compactor respectively.

Referring to FIG. 1, an apparatus 10 in accordance with this invention for selectively directing different types of recyclable material or non-recyclable material deposited in the same receptacle to an appropriate bin or a compactor respectively is shown. The apparatus 10 includes a supporting structure 12, upon which is supported a receptacle or chute 14. The top 16 of the chute 14 is open for receiving either recyclable or none recyclable material.

Figure 2:
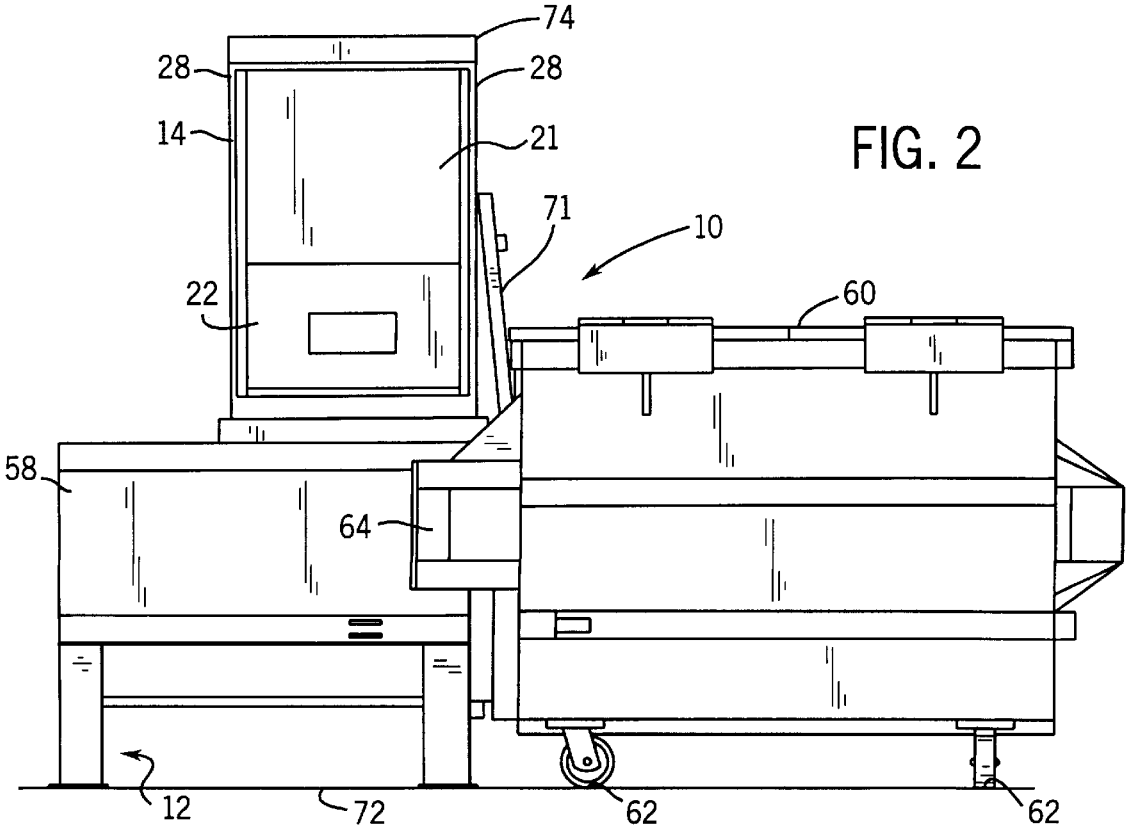
FIG. 2 is a side view of the apparatus shown in FIG. 1, with portions removed to better illustrate the apparatus of this invention.

The chute 14, which in the shown preferred embodiment is rectangular, has fixed rectangular ends one, of which 18 ,is shown in FIG. 1, and sides 20 and 21, one of which 21, is shown in FIG. 2. A lower portion of the sides, such as 22 in FIG. 2 is fixed, while upper portions 24 and 26 are pivotally mounted at their lower end. The ends and the fixed portions of the sides are secured to corner braces 28, which may for instance be formed of an angle member or of a rectangular channel.

The upper portions 24 and 26 are pivotally supported 64 shafts 30 and 32 respectively, which are in turn supported by the corner braces 28. Rotation of the upper portions 24 and 26 from a vertical position to a sloped position wherein the upper end rests against the opposite upper portion as shown by the dashed lines for upper portion 24 in FIG. 1, is caused by actuation of hydraulic operators 34 and 36 respectively. A first portion of each hydraulic operator 34 and 36 is pivotally mounted on the supporting structure 12. Secured to the shafts 30 and 32 are arms 38 and 40, which are in turn pivotally connected to extensible portions 42 and 44 of hydraulic operators 34 and 36 respectively.

As shown in FIG. 1, secured on each of the sides 20 and 21 are discharge chutes 50 and 52. To better illustrate the side 21, including upper portion 26 and lower portion 22, the discharge chute 52 is not shown in FIG. 2. The discharge chutes 50 and 52 have a sloping top and vertical side members. The bottoms of the discharge chutes 50 and 52 are open, such that movable containers 54 and 56 may be placed thereunder to receive the recyclable material which passes through the chutes 50 and 52. In the embodiment of this invention shown in FIG. 1, movable container 54 is intended to receive newspaper waste, while movable container 56 is intended to receive all other recyclable waste, referred to herein as "Co-mingle" waste. For instance, the "Co-mingle" waste may include both recyclable glass, plastic, and aluminum containers. The open bottoms of the chutes 50 and 52 are preferably the same size and shape as the open tops of the movable containers 54 and 56. However, the open bottoms of the chutes may be smaller in size, in which case it may be necessary to reposition the movable containers under the chutes 50 and 52 to entirely fill the containers with desired recyclable waste material. Suitable blocking or locking devices are provided to ensure that the movable containers 54 and 56 remain positioned under the chutes 50 and 52 while they are being filled.

Positioned directly underneath the receptacle or chute 14 is a portion of a compactor 58. As shown in FIG. 2, the storage portion 60 of compactor 58 extend from the support structure 12 which is opposite the end 18 shown in FIG. 1. The storage portion 60 is shown supported on casters 62, such that it can be removed from the support structure 12 when it is desirable to move it for emptying. The storage portion 60 is secured to the support structure 12, by suitable securing structures 64 as shown in FIG. 2.

Referring to FIG. 1, the compactor 58 includes a pair of hydraulic operators 66 and 68 which when actuated provide a force in the direction of the storage portion 60 on vertical plate 70. Thus, material dropped into the compactor 58, when both of the upper wall portions 24 and 26 are in the vertical position, is pressed into the storage portion 60, and when a sufficient volume is accumulated, compressed. When the storage portion 60 has been filled, the securing structures 64 are released and a door 71 pivoted down to close the open end of the storage portion.

In a typical installation, the support structure 12 would be supported on a floor 72, which is at such an elevation, that the top opening 16 of the chute 14 would be at the level of a floor 74 on which waste is to be collected in small containers which are then dumped into the chute 14. Similarly, the floor 72 should be at the desired level for moving the movable containers 54 and 56 for emptying or loading on a vehicle for removal.

Figure 3:
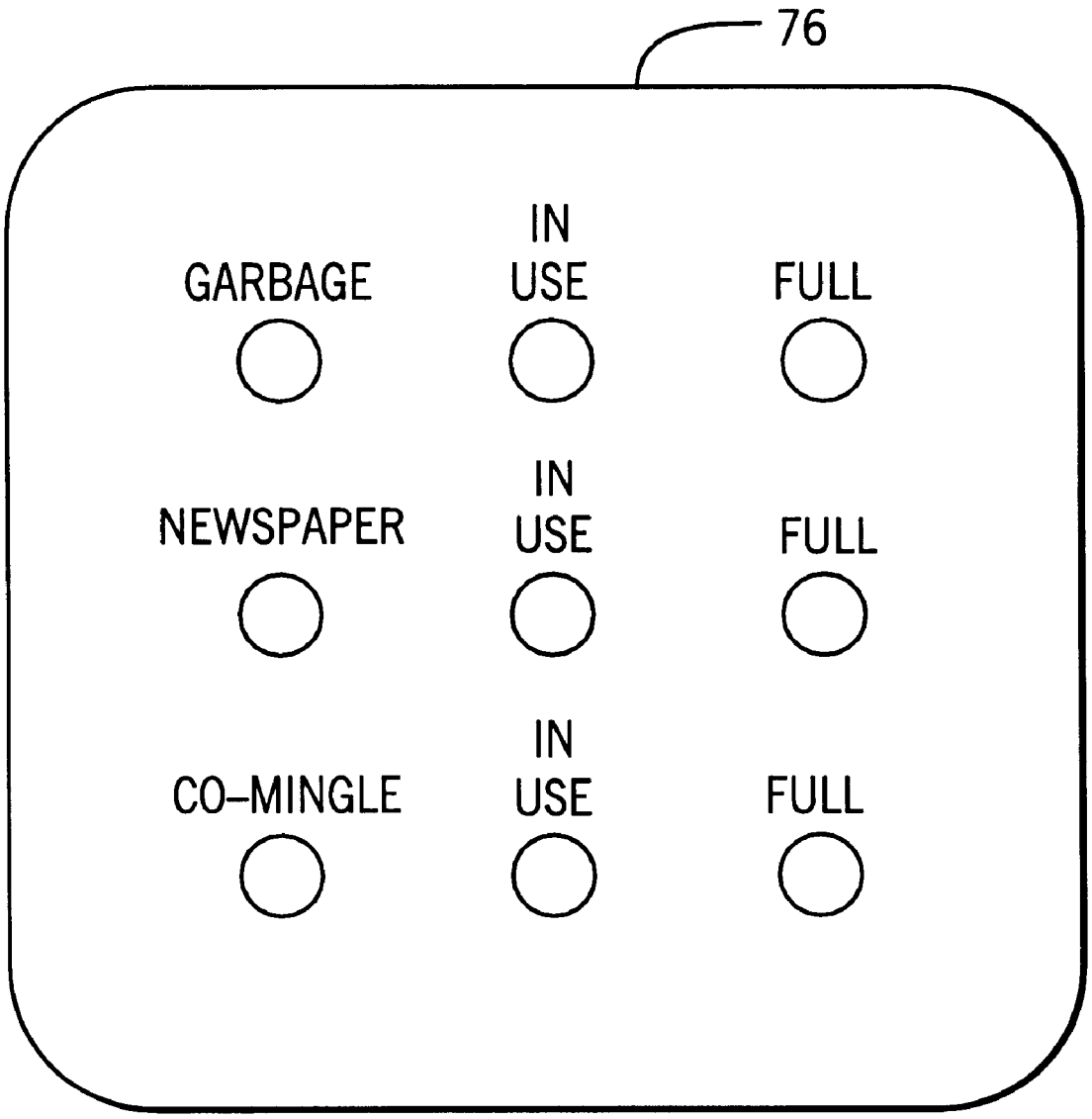
FIG. 3 is front view of a control panel used to control the apparatus shown in FIGS. 1 and 2.

The actuations of hydraulic operators 34 and 36 are controlled from a control panel conveniently located for access by a person about to dump waste material into the chute 14. The control panel 76 is shown in FIG. 3. A person about to dump a container of waste into the chute 14 would first actuate one of the operators labeled "Garbage", "Newspaper" or "Co-mingle", identifying the type of waste to be disposed of. Thus, if the actuator "Newspaper" is actuated, the upper portion 24 of the side 20 would be moved to the position shown by dashed lines in FIG. 1, such that material dropped into the chute 14 would be directed through discharge chute 50 to the moveable container 54 labeled "newspaper". Similarly, if actuator "Co-mingle" is actuated, the upper portion 26 of side 20 would be moved against the opposite side 21, such that material dropped into the chute 14 would be directed through the discharge chute 52 to the moveable container 56 labeled "Co-Mingle".

Finally, if the waste to be disposed of is "garbage", the actuator labeled "garbage" would be actuated. Actuation of the "Garbage" actuator caused both of the hydraulic operators 34 and 36 to position the upper portions 22 and 24 of the sides 20 and 21 in their vertical positions. Thus, garbage dumped into the chute 14 will fall directly into the receiving area of compactor 58.

The control panel 76 also includes "In Use" indicators, which indicate where waste deposited in the chute 14 will be direct to, i.e. movable container 54 or 56, or compactor 58. In a typical installation, each of the indicators would be a light source, with the light source energized to indicate the type of waste disposal in use.

As shown, a further set of indicators is provided to indicate when each of the movable containers 54 or 56 or the compactor 58 is full. A sensor, such as a light sensitive device normally receiving light from a light emitting source may be used to control the energization of the "Full" indicators. The light sensing device and the light emitting source would be positioned such that the light path between them would be broken when the container or the compactor with which they were associated was full. For instance, the light source and light sensing device could be mounted on opposite sides adjacent the lower edge of the discharge chutes 50 and 52. Thus, when the light path is interrupted, other than when material is falling into the container 54 and 56, the "Full" indicator would be energized, indicating that the material has filled the container.

While only one embodiment of the invention has been shown, it should be apparent to those skilled in the art that what has been described is considered at present to be a preferred embodiment of an apparatus for selectively directing different types of recyclable material or non-recyclable material deposited in the same receptacle to a selected bin or a compactor respectively of this invention. In accordance with the Patent Statute, changes may be made in the apparatus without actually departing from the true spirit and scope of this invention. The appended claims are intended to cover all such changes and modification which fall in the true spirit and scope of this invention.

What is claimed is:

1. An apparatus of receiving and storing recyclable waste materials of various types and non-recyclable waste material comprising:

a) a rectangaluar receiving chamber having sidewalls and an open bottom and an open top, b) said receiving chamber including at least two movable deflectors, c) at least two containers positioned to receive any recyclable waste material of various types and non-recyclable waste material deposited in said receiving chamber, each of said at least two containers for receiving a different type of recyclable waste from said receiving chamber, d) at least one compactor for receiving non-recyclable waste material from said receiving chamber, e) said deflectors being selectively operable to direct waste material deposited in said receiving chamber to either one of said at least two containers, or to said at least one compactor.

2. The apparatus of claim 1, wherein each of said movable deflectors is operated by a hydraulic operator.

3. The apparatus of claim 2, having a control arrangement for actuating said hydraulic operator.

4. An apparatus for receiving and storing recyclable materials of various types and non-recyclable waste material comprising:

a) a receiving chamber having sidewalls, an open top through which recyclable materials of various types and non-recyclable waste material may be deposited in said receiving chamber, and an open bottom, b) three storage containers positioned to receive from said receiving chamber at least first and second types of recyclable or non-recyclable waste materials deposited in said receiving chamber, c) two movable deflectors associated with said receiving chamber, a first one of said two deflectors in a first position forms one of said sidewalls of said receiving chamber, and a second one of said two deflectors in a first position forms another one of said sidewalls of said receiving chamber, such that any recyclable or nonrecyclable materials deposited in said receiving chamber when said first and second deflectors are in said first positions passes through said open bottom of said receiving chamber into a third one of said three storage containers, said first one of said two deflectors in a second position closes said bottom of said receiving chamber to deflect any recyclable or non-recyclable waste material deposited in said receiving chamber into a first one of said at least three storage containers, and said second one of said two deflectors in a second position closes said bottom of said receiving chamber to deflect any recyclable or non-recyclable waste material deposited in said receiving chamber into a second one of said three storage containers.

5. The apparatus of claim 4 wherein said one and said another one of said sidewalls is each provided with a chute to, direct any recyclable or non-recyclable waste material deposited in said receiving chamber into said first or second one of said three storage containers when one of said movable deflectors is in the second position.

6. The apparatus of claim 4 wherein one of said three storage containers is a compactor.

7. The apparatus of claim 4 wherein at least one of said movable deflectors is operated by a hydraulic operator.

8. The apparatus of claim 4 wherein each of said two movable defectors is operated by a hydraulic operator.

9. The apparatus of claim 8, having a control arrangement for actuating said hydraulic operator wherein both of said deflectors may be positioned in the first position, but only one of said deflectors may be positioned in the second position.

10. An apparatus for receiving and storing recyclable waste materials of various types and non-recyclable waste material comprising:

a) a receiving chamber having sidewalls and an open bottom and an open top, b) at least two movable deflectors associated with said receiving chamber, c) at least two containers, each of which is for receiving a different type of recyclable waste from said receiving chamber, d) at least one compactor for receiving non-recyclable waste material from said receiving chamber, e) said deflectors being selectively operable to direct waste material deposited in said receiving chamber to either one of said at least two containers, or to said at least one compactor, each of said at least two deflectors in a first position forms a side wall of said receiving chamber, such that non-recyclable waste material deposited in said receiving chamber can pass through said open bottom of said receiving chamber into said at least one compactor, one of said at least two deflectors in a second position closes said bottom of said receiving chamber, to deflect a first type of recyclable waste material deposited in said receiving chamber into a first one of said at least two containers, and said other one of said at least two deflectors in a second position closes said bottom of said receiving chamber to deflect a second type of recyclable waste material deposited in said receiving chamber into a second one of said at least storage containers.

11. The apparatus of claim 10 wherein each of said sidewalls is provided with a chute to direct any recyclable or non-recyclable waste material deposited in said receiving chamber into said first one or said second one of said at least two containers when said deflector are in the second positions.

* * * * *

UNITED STATES PATENT AND TRADEMARK OFFICE

CERTIFICATE OF CORRECTION

PATENT NO. : 5,950,920

DATED : September 14, 1999

INVENTOR(S) : Evelio Acosta

It is certified that error appears in the above-indentified patent and that said Letters Patent is hereby corrected as shown below:

Column 2, line 51, cancel "64" and replace with - by -.

Column 3, line 22, cancel "extend" and substitute -extends -.

Claim 10, line 32, after "least" insert - two -.

Claim 10, line 33, delete "storage".

Signed and Sealed this

Twenty-ninth Day of February, 2000

*Attest:*

Q. TODD DICKINSON

*Attesting Officer*

*Commissioner of Patents and Trademarks*